US009148929B2

(12) United States Patent
Jiang et al.

(10) Patent No.: US 9,148,929 B2
(45) Date of Patent: Sep. 29, 2015

(54) LED DRIVER CIRCUIT AND BLEEDER CIRCUIT

(71) Applicant: LIGHTING SCIENCE GROUP CORPORATION, Satellite Beach, FL (US)

(72) Inventors: Yong Jiang, Satellite Beach, FL (US); Matthew Montgomery, Indian Harbour Beach, FL (US)

(73) Assignee: LIGHTING SCIENCE GROUP CORPORATION, Melbourne, FL (US)

( * ) Notice: Subject to any disclaimer, the term of this patent is extended or adjusted under 35 U.S.C. 154(b) by 0 days.

(21) Appl. No.: 14/334,172

(22) Filed: Jul. 17, 2014

(65) Prior Publication Data

US 2015/0077004 A1 Mar. 19, 2015

Related U.S. Application Data

(60) Provisional application No. 61/858,733, filed on Jul. 26, 2013.

(51) Int. Cl.
*H05B 33/08* (2006.01)
*H05B 37/02* (2006.01)

(52) U.S. Cl.
CPC ..... *H05B 33/089* (2013.01); *H05B 33/0809* (2013.01); *H05B 37/029* (2013.01)

(58) Field of Classification Search
CPC ..... H05B 33/089; H05B 33/0809; H05B 37/029; B23K 11/248; H02M 1/02
USPC ..... 315/201
See application file for complete search history.

(56) References Cited

U.S. PATENT DOCUMENTS

2015/0077004 A1* 3/2015 Jiang et al. ..... 315/201
2015/0137688 A1* 5/2015 Gibbs ..... H05B 33/0815
2015/0137704 A1* 5/2015 Angles et al. ..... H05B 33/0815

* cited by examiner

*Primary Examiner* — Dylan White
(74) *Attorney, Agent, or Firm* — Mark Malek; Daniel Pierron; Widerman Malek, PL

(57) ABSTRACT

A bleeder circuit includes a first resistor, a thermistor, a transistor, a second resistor, and a diode section. The first resistor biases the transistor into an always-on status. The second resistor prevents current from flowing through the thermistor responsive to a voltage at the positive terminal being greater than a minimum forward voltage of a load. The thermistor increases in electrical resistance, limiting the current flowing therethrough and preventing damage to the load responsive to the load short-circuiting.

20 Claims, 3 Drawing Sheets

LED DRIVER CIRCUIT AND BLEEDER CIRCUIT

RELATED APPLICATIONS

This application claims the benefit under 35 U.S.C. §119 (e) of U.S. Provisional Patent Application Ser. No. 61/858,733 entitled LED Dimming Circuits and Associated Methods filed Jul. 26, 2013, the entire content of which is incorporated herein by reference in its entirety except to the extent disclosure therein is inconsistent with disclosure herein.

FIELD OF THE INVENTION

The present invention relates to driver circuits and, more particularly, to LED dimming circuits and bleeder circuits.

BACKGROUND

There is an existing problem in LED-based light bulbs that are configured to be retrofitted into circuitry including traditional Triode Alternating Current (TRIAC) dimming circuits. Visible flickering is possible because the TRIAC may conduct insufficient current to remain on for a whole conduction angle, known as a misfire. Such a condition will occur in the circuit depicted in FIG. 1. A solution is to draw a holding current so as to prevent misfire, known as a bleeder circuit. Because a bleeder circuit is by design always conducting current when current is not being drawn by an electric load, when there is a failure in the load, the bleeder circuit will continue to draw current. This frequently results in the overheating of the entire circuit, causing damage beyond the initial failure. Accordingly, there is a need in the art for a bleeder circuit that may draw current as desired, such as to prevent misfire in a TRIAC circuit, while also providing protection against overcurrent.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a driver circuit that may comprise a rectifier electrically connected to a power source, a plurality of light-emitting diodes (LEDs), and a controller operably coupled to the plurality of LEDs. The driver circuit may further comprise a bleeder circuit connected to the rectifier that may comprise a first resistor positioned such that a first terminal thereof is connected to a positive terminal of the rectifier, a thermistor positioned such that a first terminal thereof is connected to the positive terminal of the rectifier, a transistor positioned such that a second terminal of the first resistor is connected to a base of the transistor and a second terminal of the thermistor is connected to a collector of the transistor, a second resistor positioned such that a first terminal thereof is connected to an emitter of the transistor, and a diode section positioned so as to be connected to the second terminal of the first resistor and the base of the transistor. The first resistor may be configured to bias the transistor into an always-on status. Additionally, the second resistor may be configured so as to prevent current from flowing through the thermistor responsive to a voltage at the positive terminal being greater than a minimum forward voltage of the plurality of LED dies. Furthermore, the thermistor may be configured to increase in temperature, thereby increasing the electrical resistance thereof, limiting the current flowing therethrough and preventing damage to the driver circuit responsive to the plurality of LED dies short-circuiting.

In some embodiments, the thermistor may have a resistance within the range from 100 to 3 kΩ. Additionally, the first resistor may have a resistance within the range from 10 kΩ to 5 MΩ. The second resistor may have a resistance within the range from 1Ω to 100Ω.

In some embodiments, the diode section may comprise a first diode positioned such that an anode of the first diode is connected to the second terminal of the first resistor and the base of the transistor and a second diode positioned such that an anode of the second diode is connected to a cathode of the first diode.

In some embodiments, the diode section may comprise a Zener diode positioned such that a cathode of the Zener diode is connected to the second terminal of the first resistor and the base of the transistor. Additionally, the thermistor and the transistor may be configured such that a sum of a base-to-emitter voltage drop of the transistor and a voltage drop across the first resistor is greater than a breakdown voltage of the Zener diode. Furthermore, the Zener diode may be configured to have a breakdown voltage within the range from 0.7 V to 10 V.

Additional embodiments of the present invention are related to a bleeder circuit comprising a first resistor positioned such that a first terminal thereof is connected to a power supply terminal, a thermistor positioned such that a first terminal thereof is connected to the power supply terminal, a transistor positioned such that a second terminal of the first resistor is connected to a base of the transistor and a second terminal of the thermistor is connected to a collector of the transistor, a second resistor positioned such that a first terminal thereof is connected to an emitter of the transistor, and a diode section positioned so as to be connected to the second terminal of the first resistor and the base of the transistor. The first resistor may be configured to bias the transistor into an always-on status. Additionally, the second resistor may be configured so as to prevent current from flowing through the thermistor responsive to a voltage at the positive terminal being greater than a minimum forward voltage of a load. Furthermore, the thermistor may be configured to increase in temperature, thereby increasing the electrical resistance thereof, limiting the current flowing therethrough and preventing damage to the driver circuit responsive to the load short-circuiting.

In some embodiments, the thermistor may have a resistance within the range from 10Ω to 3 kΩ. Furthermore, the thermistor may have a resistance within the range from 10Ω to 3 kΩ. Additionally, the second resistor may have a resistance within the range from 1Ω to 100Ω.

In some embodiments, the diode section may comprise a first diode positioned such that an anode of the first diode is connected to the second terminal of the first resistor and the base of the transistor and a second diode positioned such that an anode of the second diode is connected to a cathode of the first diode.

In some embodiments, the diode section may comprise a Zener diode positioned such that a cathode of the Zener diode is connected to the second terminal of the first resistor and the base of the transistor. Furthermore, the thermistor and the transistor may be configured such that a sum of a base-to-emitter voltage drop of the transistor and a voltage drop across the first resistor is greater than a breakdown voltage of the Zener diode. Additionally, the Zener diode may be configured to have a breakdown voltage within the range from 0.7 V to 10 V.

Additional embodiments of the present invention are related to a bleeder circuit comprising a first resistor positioned such that a first terminal thereof is connected to a power supply terminal, a thermistor positioned such that a first terminal thereof is connected to the power supply terminal, a transistor positioned such that a second terminal of the first resistor is connected to a base of the transistor and a second terminal of the thermistor is connected to a collector of the transistor, a second resistor positioned such that a first terminal thereof is connected to an emitter of the transistor, and a diode section positioned so as to be connected to the second terminal of the first resistor and the base of the transistor. The first resistor may be configured to bias the transistor into an always-on status. Additionally, the second resistor may be configured so as to prevent current from flowing through the thermistor responsive to a voltage at the positive terminal being greater than a minimum forward voltage of a load. Furthermore, the thermistor may be configured to increase in temperature, thereby increasing the electrical resistance thereof, limiting the current flowing therethrough and preventing damage to the driver circuit responsive to the load short-circuiting. The thermistor may have a resistance within the range from 100 to 3 kΩ. The first resistor may have a resistance within the range from 10 kΩ to 5 MΩ. The second resistor may have a resistance within the range from 1Ω to 100Ω.

In some embodiments, the diode section may comprise a first diode positioned such that an anode of the first diode is connected to the second terminal of the first resistor and the base of the transistor and a second diode positioned such that an anode of the second diode is connected to a cathode of the first diode.

In some embodiments, the diode section may comprise a Zener diode positioned such that a cathode of the Zener diode is connected to the second terminal of the first resistor and the base of the transistor. Additionally, the thermistor and the transistor may be configured such that a sum of a base-to-emitter voltage drop of the transistor and a voltage drop across the first resistor is greater than a breakdown voltage of the Zener diode.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention text, as shown and described by the various figures and accompanying text, provides a bleeder circuit that may be used in conjunction with a TRIAC device to provide dimming capability to an LED lighting system.

Figure 2:
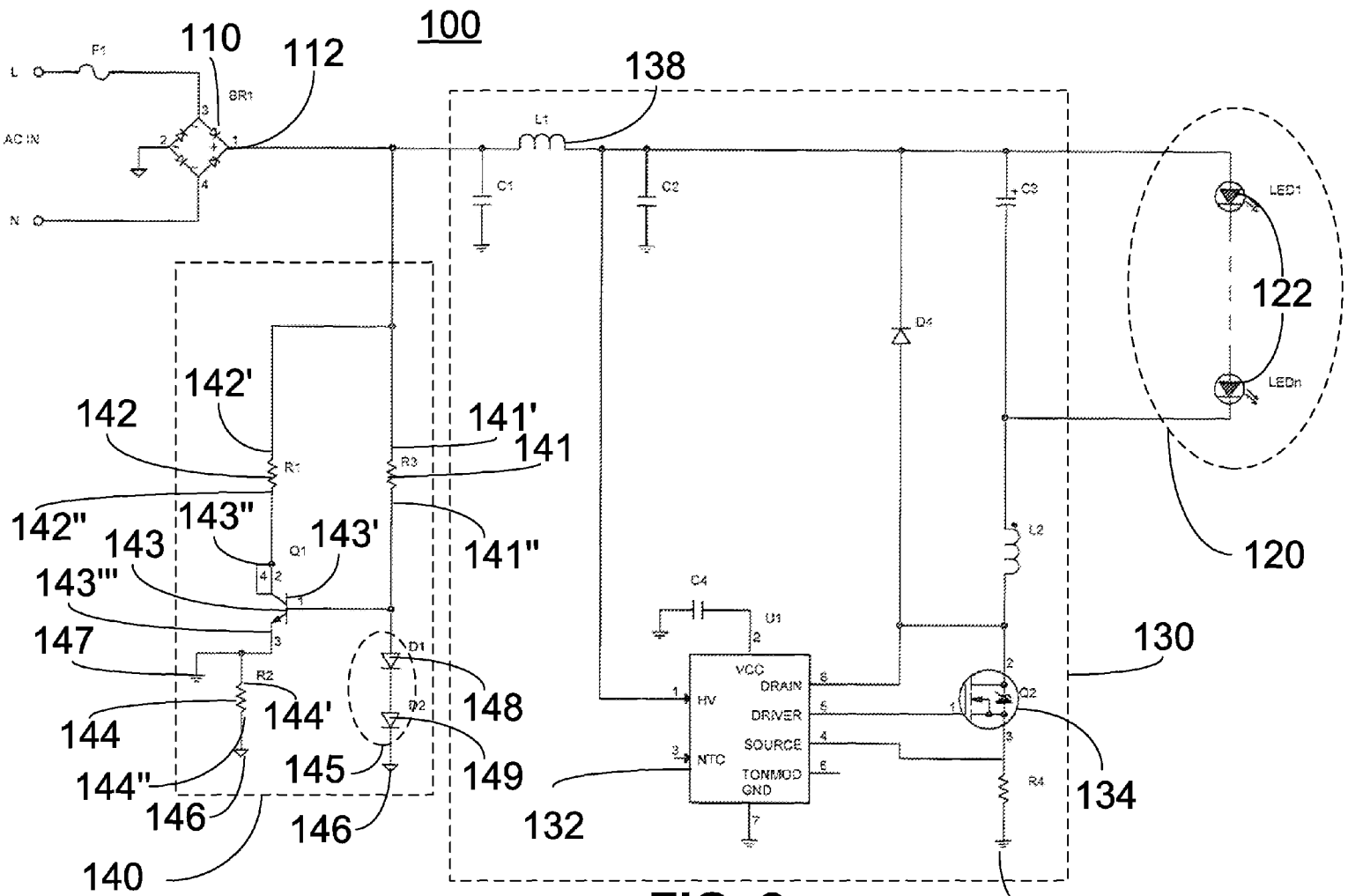
FIG. 2 is a schematic view of a driver circuit comprising a bleeder circuit according to an embodiment of the present invention.

Referring now to FIG. 2, a driver circuit 100 according to an embodiment of the present invention is presented. The driver circuit 100 may comprise a rectifier 110, a load 120, a controller circuit 130, and a bleeder circuit 140. The rectifier 110 may be electrically connected to a power source. In some embodiments, the power source may be an alternating current (AC) power source. Furthermore, the power source may comprise any type of waveform, including sinusoidal, saw tooth, triangular, and any partial waveforms thereof. In the present embodiment, the power source may be a TRIAC device. The rectifier 110 may be configured to alter the waveform of the power supplied by the power source. For example, the rectifier 110 may be a half-wave rectifier, a full-wave rectifier, single-phase rectifier, three-phase rectifier, and any other type of rectifier as is known in the art. Furthermore, the rectifier 110 may comprise a transformer, a bridge circuit (as in the present embodiment), or any type of rectifier as is known in the art.

The load 120 may be any type of electrical load for which a bleeder circuit has utility. Furthermore, the load 120 may be any electrical device or component for which electrical power is supplied and that has characteristics that may result in at least one of misfiring of a TRIAC-supplied power source and an overcurrent condition. In the present embodiment, the load 120 is a lighting circuit. More specifically, the load 120 comprises a plurality of serially-connected light-emitting diodes (LEDs) 122. The plurality of LEDs 122 may comprise any number and type of LEDs as are known in the art. Furthermore, while the present embodiment depicts a single string of serially-connected LEDs, LEDs in any configuration are contemplated and included within the scope of the invention.

The load 120 may be positioned in electrical communication with the controller circuit 130. The controller circuit 130 may be connected to the load 120 so to be operably connected to the load 120. The controller circuit 130 may be configured to control the operation of the load 120. Furthermore, the controller circuit 130 may be configured to control the operation of the load 120 responsive to the waveform of power supplied thereto. In some embodiments, the controller circuit 130 may be electrically connected to the rectifier 110, receiving electrical power thereby. More specifically, the controller circuit 130 may be connected to a positive terminal 112 of the rectifier 110.

The controller circuit 130 may comprise components enabling the controlling of the operation of the load 120, such as, but not limited to, a controller 132 and a transistor 134. The transistor 134 may be positioned electrically between the load 120 and a ground 136, in this embodiment an earth ground. Furthermore, the controller 132 may be configured so as to control the operation of the transistor 134 to effectively control the operation of the load 120. In the present embodiment, the transistor 134 is an N-channel metal-oxide-semiconductor field-effect transistor (MOSFET). All other types of transistors as are known in the art, including BJTs, including n-p-n and p-n-p types thereof, and all types of FETs, including MOSFETs, and n- and p-channel types thereof, are contemplated and included within the scope of the invention.

Continuing to refer to FIG. 2, the bleeder circuit 140 will now be discussed in greater detail. While the bleeder circuit 140 will be discussed in the context of the present invention, namely, within the context of the driver circuit 100 additionally comprising the rectifier 110, the load 120 that comprises a plurality of LEDs 122, and the controller circuit 130, it is contemplated that the bleeder circuit 140 may be implemented in any other circuit where a bleeder circuit may have utility. Furthermore, the particular values assigned to the various components of the bleeder circuit 140 are understood to be within the context of the present embodiment. Other values for the components comprised by the bleeder circuit 140, to the extent those values may be changes to accomplish the functionality described herein, is contemplated and included within the scope of the invention. Accordingly, the values given for the components comprised by the bleeder circuit 140 are exemplary only and non-limiting.

As stated hereinabove, the bleeder circuit 140 may be configured to draw current so as to prevent TRIAC misfire, and further, to prevent an overcurrent condition from damaging other components of the driver circuit 100. In the present embodiment, the bleeder circuit 140 may comprise a first resistor 141, a thermistor 142, a transistor 143, a second resistor 144, and a diode section 145. The first resistor 141 may be positioned so as to be connected to a current source. In the present embodiment, the first resistor 141 may be positioned so as to be connected to the rectifier 110. More specifically, a first terminal 141' of the first resistor 141 may be positioned so as to be connected to a positive terminal 112 of the rectifier 110. Furthermore, the first resistor 141 may be positioned so as to be connected to the same terminal of the rectifier 110 as the controller circuit 130. The first resistor 141 may be positioned so as to have a common voltage at the first terminal 141' as current entering the controller circuit 130. Additionally, the first terminal 131 may be positioned such that an inductor 138 comprised by the controller circuit 130 is intermediate the first resistor 141 and at least one of the load 120 and the controller 132.

Because the first resistor 141, along with the thermistor 142, is electrically connected with elements of the driver circuit 100 not comprised by the bleeder circuit 140, the relationship with which the first resistor 141 is described to be connected to the various other elements of the driver circuit 141 may similarly be attributed to the thermistor 142 as well as the bleeder circuit 140 generally.

Additionally, the first resistor 141 may be configured to have a resistance within the range from 10 kΩ to 5 MΩ. In some embodiments, the first resistor 141 may have a resistance that is proportionately larger than a resistance of the thermistor 142. In some embodiments, the first resistor 141 may have a resistance that is proportionately larger than at least one of a resistance of the thermistor 142 at room temperature, such as approximately 25 degrees Celsius, and a resistance of the thermistor 142 at a maximum temperature or temperature gradient. Furthermore, the first resistor 141 may have a resistance that is a multiple of the resistance of the thermistor 142 within the range from 10 times to 1,000 times.

Similar to the first resistor 141, the thermistor 142 may be positioned so as to be connected to a current source, such as such that a first terminal 142' of the thermistor 142 is connected to the positive terminal 112 of the rectifier 110. Furthermore, the thermistor 142 may be positioned such that if there is a failure in a component of at least one of the load 120 and the controller circuit 130, current will flow through the thermistor 142. Furthermore, the thermistor 142 may be positioned such that as an increased amount of current flows through the driver circuit 100 as a result of the failure in either or both of the load 120 and the controller circuit 130, the increased amount of current will result in an increase in the temperature of the thermistor 142, thereby resulting in an increase of the resistance of the thermistor 142. Accordingly, the thermistor 142 may be a resistor that has a positive temperature coefficient (PTC). Additionally, the thermistor 142 may have a resistance within the range from 10Ω to 3 kΩ.

The transistor 143 may be any type of transistor as is known in the art, as recited hereinabove. In the present embodiment, the transistor 143 may be an NPN-type BJT. Furthermore, in the present embodiment, the transistor 143 may comprise a base 143', a collector 143", and an emitter 143'". The transistor 143 may be positioned such that the base 143' is connected to a second terminal 141" of the first resistor 141 and such that the collector 143" is connected to a second terminal 142" of the thermistor 142.

The first resistor 141 may be configured to have a resistance that biases the transistor 143 into an always-on status. More specifically, the first resistor 141 may be configured to reduce the voltage at the base 143' of the transistor 143 so as to be less than the voltage at the collector 143", but greater than the voltage at the emitter 142'", thereby putting the transistor 143 into a forward-active status.

In some embodiments, the second resistor 144 may be positioned so as to be connected to the transistor 143. More specifically, the second resistor 144 may be positioned such that a first terminal 144' thereof may be connected to the emitter 143'" of the transistor 143. Furthermore, the second resistor 144 may be positioned so as to be intermediate the transistor 143 and a ground 146, in this embodiment a signal ground. Furthermore, in some embodiments, the emitter 143'" of the transistor 143 may be connected to an earth ground 147.

The second resistor 144 may be configured to have a resistance that prevents current from flowing through the emitter 143'" of the transistor 143 responsive to a voltage at the positive terminal 112 of the rectifier 110 that is greater than a minimum voltage of the load 120. The minimum voltage of the load 120 may be understood as a minimum voltage required for operation of the electrical components of the load 120. More specifically, the second resistor 144 may have a resistance such that where the load 120 is conducting current, the voltage drop across the second resistor 144 may be at least 0.7V. Where the load 120 comprises a plurality of LEDs 122, the second resistor 144 may prevent current from flowing through the emitter 143" of the transistor 143 responsive to a voltage at the positive terminal 112 that is greater than a minimum forward voltage of the plurality of LEDs, the minimum forward voltage being understood as a voltage that may cause all the LEDs of the plurality of LEDs 122 to emit light.

In some embodiments, the second resistor 144 may have a resistance within the range from 1Ω to 100Ω.

The diode section 145 may comprise one or more diodes and be configured to maintain a voltage at the base 143' of the transistor 143 so as to bias the transistor 143 into an always-on status. In the present embodiments, the diode section 145 may comprise a plurality of diodes, comprising at least a first diode 148 and a second diode 149. The first diode 148 may be positioned so as to be connected to the first resistor 141. Furthermore, the first diode 148 may be positioned so as to be connected to the transistor 143. More specifically, the first diode 148 may be positioned such that an anode 148' thereof is connected to each of the second terminal 141" of the first resistor 141 and the base 143' of the terminal 143.

The second diode 149 may be positioned so as to be connected to the first diode. Furthermore, the second diode 149 may be positioned so as to be connected to the ground 146, which may be a signal ground. Additionally, the second diode 149 may be positioned such that an anode 149' thereof is connected to a cathode 148" of the first diode 148, and such that a cathode 149" thereof is connected to a ground 146, which may be a signal ground.

Figure 1:
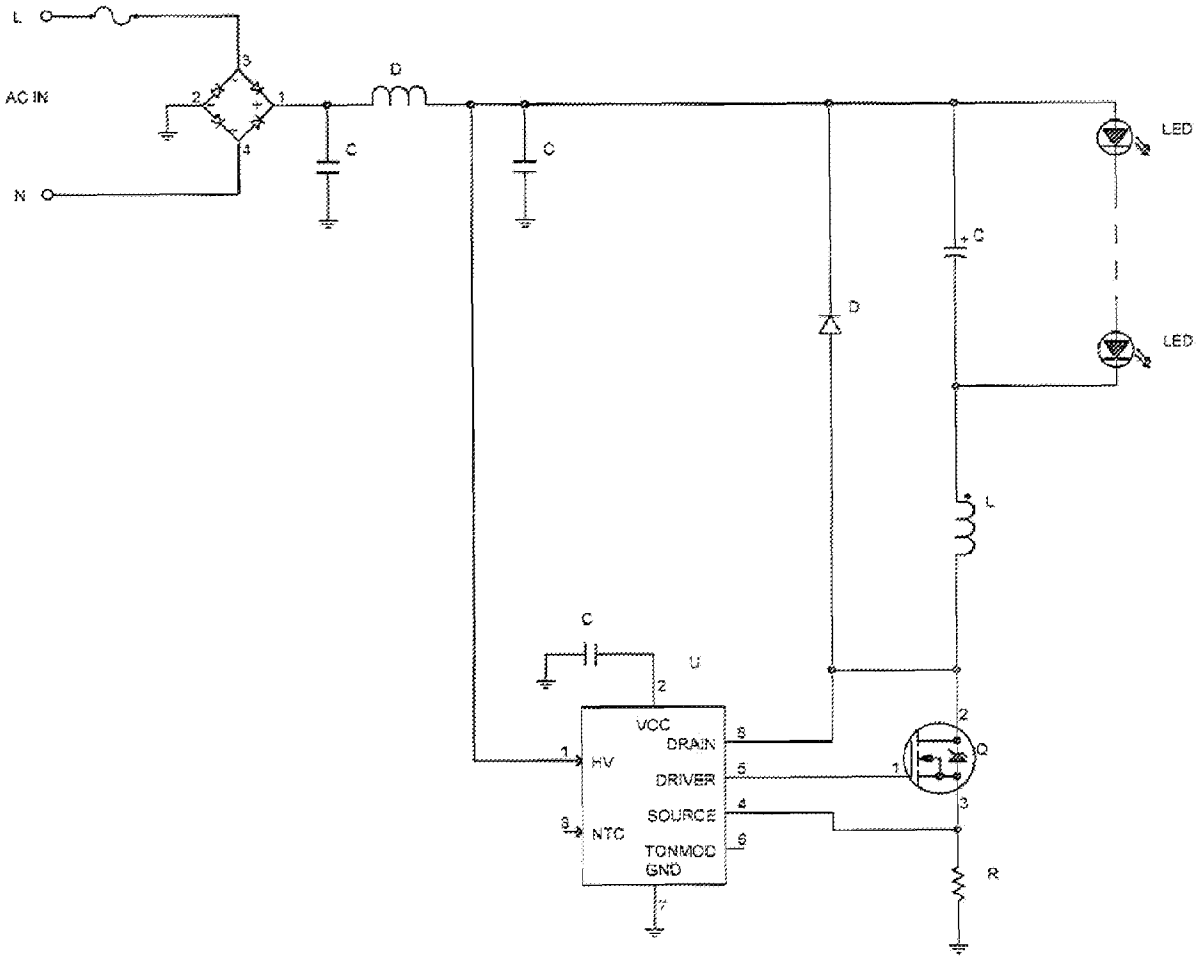
FIG. 1 (PRIOR ART)
FIG. 1 is a schematic view of a driver circuit according to the prior art.
Figure 3:
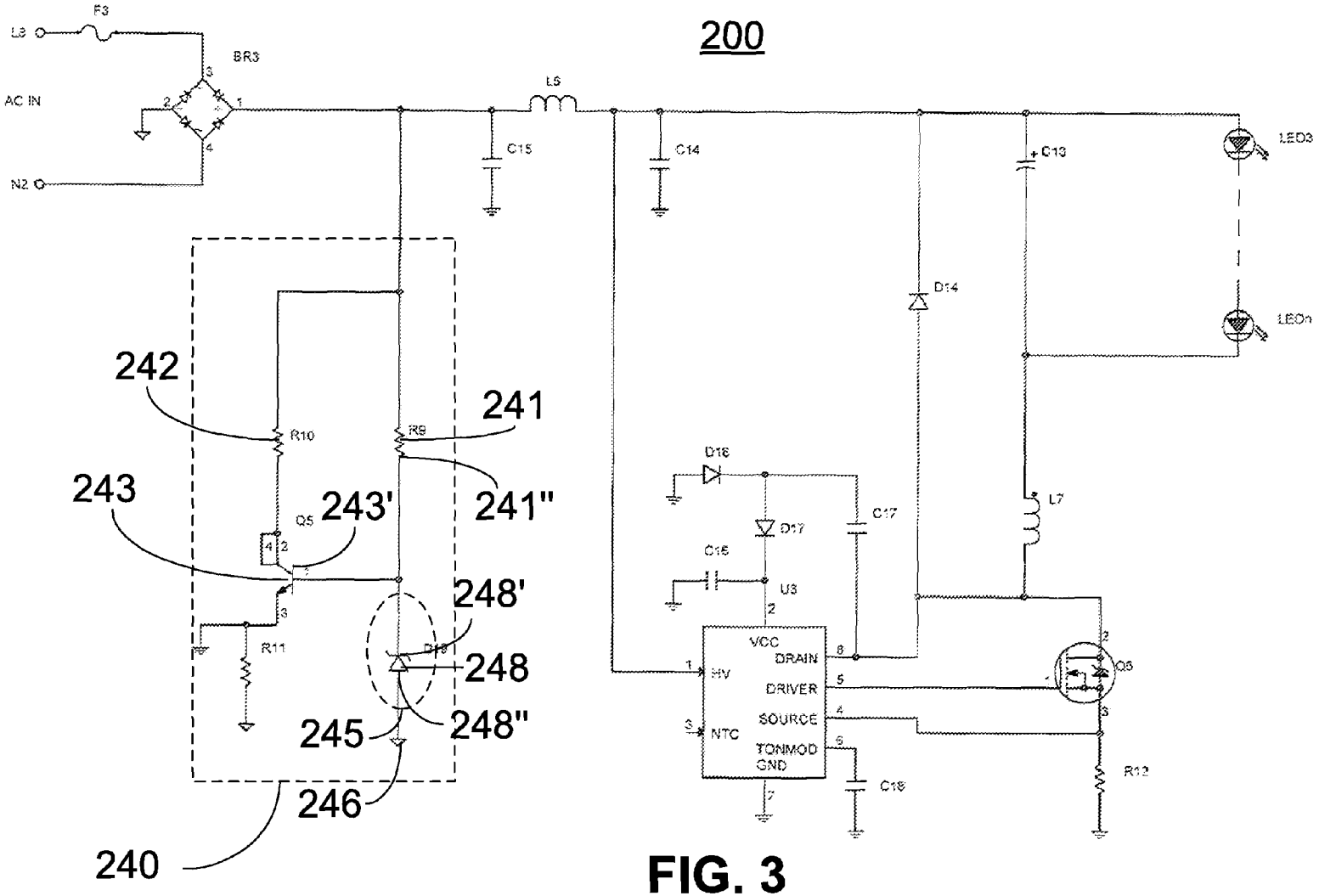
FIG. 3 is a schematic view of a driver circuit comprising a bleeder circuit according to an alternative embodiment of the present invention.

Referring now to FIG. 3, a driver circuit 200 according to another embodiment of the invention is presented. The driver circuit 200 may be substantially identical to the driver circuit 100 illustrated in FIG. 1, with the exception of the diode section 245 of the bleeder circuit 240. In the present embodiment, the diode section 245 may comprise a Zener diode 248. The Zener diode 248 may be positioned so as to be connected to each of a first resistor 241 and a transistor 243. More specifically, the Zener diode 248 may be positioned such that a cathode 248' thereof is connected to each of a second terminal 241" of the first resistor 241 and a base 243' of the transistor 243. Furthermore, an anode 248" of the Zener diode 248 may be connected to a ground 246, which may be a signal ground. In the bleeder circuit 240, a thermistor 242 and the transistor 243 may be configured such that the sum of a base-to-emitter voltage drop of the transistor and a voltage drop across the first resistor is greater than a breakdown voltage is greater than a breakdown voltage of the Zener diode 248. In some embodiments, the Zener diode may have a breakdown voltage within the range from 0.7V to 10V.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A driver circuit comprising:

a rectifier electrically connected to a power source;

a plurality of light-emitting diodes (LEDs);

a controller circuit operably coupled to the plurality of LEDs; and a bleeder circuit connected to the rectifier comprising:

a first resistor positioned such that a first terminal thereof is connected to a positive terminal of the rectifier, a thermistor positioned such that a first terminal thereof is connected to the positive terminal of the rectifier, a transistor positioned such that a second terminal of the first resistor is connected to a base of the transistor and a second terminal of the thermistor is connected to a collector of the transistor, a second resistor positioned such that a first terminal thereof is connected to an emitter of the transistor, and a diode section positioned so as to be connected to the second terminal of the first resistor and the base of the transistor;

wherein the first resistor is configured to bias the transistor into an always-on status;

wherein the second resistor is configured so as to prevent current from flowing through the thermistor responsive to a voltage at the positive terminal being greater than a minimum forward voltage of the plurality of LED dies; and wherein the thermistor is configured to increase in temperature, thereby increasing the electrical resistance thereof, limiting the current flowing therethrough and preventing damage to the driver circuit responsive to the plurality of LED dies short-circuiting.

2. The driver circuit according to claim 1 wherein the thermistor has a resistance within the range from 10Ω to 3 kΩ.

3. The driver circuit according to claim 1 wherein the first resistor has a resistance within the range from 10 kΩ to 5 MΩ.

4. The driver circuit according to claim 1 wherein the second resistor has a resistance within the range from 1Ω to 100Ω.

5. The driver circuit according to claim 1 wherein the diode section comprises a first diode positioned such that an anode of the first diode is connected to the second terminal of the first resistor and the base of the transistor and a second diode positioned such that an anode of the second diode is connected to a cathode of the first diode.

6. The driver circuit according to claim 1 wherein the diode section comprises a Zener diode positioned such that a cathode of the Zener diode is connected to the second terminal of the first resistor and the base of the transistor.

7. The driver circuit according to claim 6 wherein the thermistor and the transistor are configured such that the sum of a base-to-emitter voltage drop of the transistor and a voltage drop across the first resistor is greater than a breakdown voltage of the Zener diode.

8. The driver circuit according to claim 6 wherein the Zener diode is configured to have a breakdown voltage within the range from 0.7 V to 10 V.

9. A bleeder circuit comprising:

a first resistor positioned such that a first terminal thereof is connected to a power supply terminal;

a thermistor positioned such that a first terminal thereof is connected to the power supply terminal;

a transistor positioned such that a second terminal of the first resistor is connected to a base of the transistor and a second terminal of the thermistor is connected to a collector of the transistor;

a second resistor positioned such that a first terminal thereof is connected to an emitter of the transistor; and a diode section positioned so as to be connected to the second terminal of the first resistor and the base of the transistor;

wherein the first resistor is configured to bias the transistor into an always-on status;

wherein the second resistor is configured so as to prevent current from flowing through the thermistor responsive to a voltage at the power supply terminal being greater than a minimum forward voltage of a load; and wherein the thermistor is configured to increase in temperature, thereby increasing the electrical resistance thereof, limiting the current flowing therethrough and preventing damage to the load responsive to the load short-circuiting.

10. The bleeder circuit according to claim 9 wherein the thermistor has a resistance within the range from 10Ω to 3 kΩ.

11. The bleeder circuit according to claim 9 wherein the first resistor has a resistance within the range from 10 kΩ to 5 MΩ.

12. The bleeder circuit according to claim 9 wherein the second resistor has a resistance within the range from 1Ω to 100Ω.

13. The bleeder circuit according to claim 9 wherein the diode section comprises a first diode positioned such that an anode of the first diode is connected to the second terminal of the first resistor and the base of the transistor and a second diode positioned such that an anode of the second diode is connected to a cathode of the first diode.

14. The bleeder circuit according to claim 9 wherein the diode section comprises a Zener diode positioned such that a cathode of the Zener diode is connected to the second terminal of the first resistor and the base of the transistor.

15. The bleeder circuit according to claim 14 wherein the thermistor and the transistor are configured such that a sum of a base-to-emitter voltage drop of the transistor and a voltage drop across the first resistor is greater than a breakdown voltage of the Zener diode.

16. The bleeder circuit according to claim 14 wherein the Zener diode is configured to have a breakdown voltage within the range from 0.7 V to 10 V.

17. A bleeder circuit comprising:

a first resistor positioned such that a first terminal thereof is connected to a power supply terminal;

a thermistor positioned such that a first terminal thereof is connected to the power supply terminal;

a transistor positioned such that a second terminal of the first resistor is connected to a base of the transistor and a second terminal of the thermistor is connected to a collector of the transistor;

a second resistor positioned such that a first terminal thereof is connected to an emitter of the transistor; and a diode section positioned so as to be connected to the second terminal of the first resistor and the base of the transistor;

wherein the first resistor is configured to bias the transistor into an always-on status;

wherein the second resistor is configured so as to prevent current from flowing through the thermistor responsive to a voltage at the power supply terminal being greater than a minimum forward voltage of a load;

wherein the thermistor is configured to increase in temperature, thereby increasing the electrical resistance thereof, limiting the current flowing therethrough and preventing damage to the load circuit responsive to the load short-circuiting;

wherein the thermistor has a resistance within the range from 10Ω to 3 kΩ;

wherein the first resistor has a resistance within the range from 10 kΩ to 5 MΩ; and wherein the second resistor has a resistance within the range from 1Ω to 100Ω.

18. The bleeder circuit according to claim 17 wherein the diode section comprises a first diode positioned such that an anode of the first diode is connected to the second terminal of the first resistor and the base of the transistor and a second diode positioned such that an anode of the second diode is connected to a cathode of the first diode.

19. The bleeder circuit according to claim 17 wherein the diode section comprises a Zener diode positioned such that a cathode of the Zener diode is connected to the second terminal of the first resistor and the base of the transistor.

20. The bleeder circuit according to claim 19 wherein the thermistor and the transistor are configured such that a sum of a base-to-emitter voltage drop of the transistor and a voltage drop across the first resistor is greater than a breakdown voltage of the Zener diode.

* * * * *